US007946328B2

(12) United States Patent
Fox et al.

(10) Patent No.: US 7,946,328 B2
(45) Date of Patent: May 24, 2011

(54) QUICK CHANGE TAPE APPLICATION ROLLERS WITHIN A CARTON OR CASE SEALING APPARATUS

(75) Inventors: Bryce J. Fox, Honesdale, PA (US); William J. Menta, West Wyoming, PA (US)

(73) Assignee: Illinois Tool Works Inc., Glenview, IL (US)

( * ) Notice: Subject to any disclaimer, the term of this patent is extended or adjusted under 35 U.S.C. 154(b) by 136 days.

(21) Appl. No.: 12/379,008

(22) Filed: Feb. 11, 2009

(65) Prior Publication Data

US 2009/0218048 A1 Sep. 3, 2009

Related U.S. Application Data

(60) Provisional application No. 61/064,362, filed on Feb. 29, 2008.

(51) Int. Cl.
*B65B 51/06* (2006.01)
*B29C 63/04* (2006.01)

(52) U.S. Cl. ..... 156/486; 156/475; 156/478; 156/480; 156/487; 156/488; 156/489; 156/493; 156/510; 156/516

(58) Field of Classification Search ..... 156/250, 156/252, 256, 475, 477.1, 478–480, 486–489, 156/493, 510, 516; 242/404; 53/136.4; 411/516, 411/517, 530

See application file for complete search history.

(56) References Cited

U.S. PATENT DOCUMENTS 2,683,599 A * 7/1954 Davidson et al. ..... 226/79
4,640,731 A * 2/1987 Lerner et al. ..... 156/355
5,423,104 A * 6/1995 West ..... 15/100

* cited by examiner

*Primary Examiner* — Mark A Osele
*Assistant Examiner* — Christopher C Caillouet
(74) *Attorney, Agent, or Firm* — Law Offices of Steven W. Weinrieb

(57) ABSTRACT

A system for mounting the front or rear sealing tape application roller of a carton or case sealing apparatus wherein the front or rear tape application roller is able to be quickly and easily replaced upon its roller shaft without the need for special tools. A spring-biased detent pin which is spring-biased between a radially outwardly position at which the detent pin so as to be engaged with and block removal of the roller from its roller shaft but which may be depressed radially inwardly so as to be disengaged from the roller and thereby permit the roller to be removed from its roller shaft.

12 Claims, 2 Drawing Sheets

QUICK CHANGE TAPE APPLICATION ROLLERS WITHIN A CARTON OR CASE SEALING APPARATUS

CROSS-REFERENCE TO RELATED PATENT APPLICATIONS

This patent application is related to, based upon, and effectively a utility patent application conversion of U.S. Provisional Patent Application Ser. No. 61/064,362 which was filed on Feb. 29, 2008, the date benefits of which are hereby claimed and the entirety of which is incorporated herein by reference to the extent permitted by law.

FIELD OF THE INVENTION

The present invention relates generally to carton or case sealing apparatus, and more particularly to a new and improved system for mounting the tape application rollers of the carton or case sealing apparatus wherein the tape application rollers are able to be quickly and easily removed and replaced without the need for special tools. While the disclosure will be described in connection with the front tape application roller, the new and improved system of the present invention is adapted to be incorporated with the mounting of both the front and rear tape application rollers.

BACKGROUND OF THE INVENTION

In connection with carton or case sealing apparatus, various component parts thereof will wear out and require replacement after numerous operating cycles. The replacement of such parts usually requires the use of special tools by maintenance personnel that obviously entails a considerable amount of time to implement as well as additional expense for the performance of the maintenance operations. In addition, the carton or case sealing production line is shut down at this point in time causing not only a loss in production time but, in addition, loss of revenue in connection with the number of sealed cartons or cases that can be produced within a given amount of production time.

A need therefore exists in the art for a new and improved mounting system of a carton or case sealing apparatus wherein, for example, the front and rear tape application rollers of the carton or case sealing apparatus can be quickly and easily removed and replaced by new or fresh front and rear tape application rollers by operator or maintenance personnel without the need for the use of special tools.

SUMMARY OF THE INVENTION

The foregoing and other objectives are achieved in accordance with the teachings and principles of the present invention through the provision of a new and improved system for mounting the front and rear application rollers of carton or case sealing apparatus which comprises the disposition of the front and rear application roller rotatably mounted upon suitable roller shafts, and the provision of a spring-biased detent mounted upon an end portion of each roller shaft. The spring-biased detent is normally biased toward its radially outward position at which the spring-biased detent will normally engage the outer end of the front or rear tape application roller, such that if, for example, personnel attempted to remove the front or rear application roller from its roller shaft, the removal of the front or rear tape application roller from its roller shaft would effectively be blocked thereby ensuring the fact that the front or rear tape application roller would be maintained upon its roller shaft when so desired and is not inadvertently or accidentally removed from its roller shaft. When the front or rear tape application roller is in fact to be removed from its roller shaft, such as, for example, when the front or rear tape application roller is to be replaced as result of, for example, being worn, the spring-biased detent is moved or depressed radially inwardly so as to no longer be disposed at its radially outward position engaging the outer end of the front or rear tape application roller and thereby blocking the removal of the front or rear tape application roller from its roller shaft, the front or rear tape application roller may then, in effect, be slidably moved along its axial direction so as to pass over or beyond the spring-biased detent and thereby be removed from its roller shaft, and a new front or rear tape application roller can then be slidably mounted upon the roller shaft while maintaining the spring-biased detent at its depressed position. After the new front or rear tape application roller has passed over or beyond the depressed spring-biased detent, the spring-biased detent is re-leased thereby effectively maintaining the new front or rear tape application roller upon its roller shaft.

BRIEF DESCRIPTION OF THE DRAWING

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
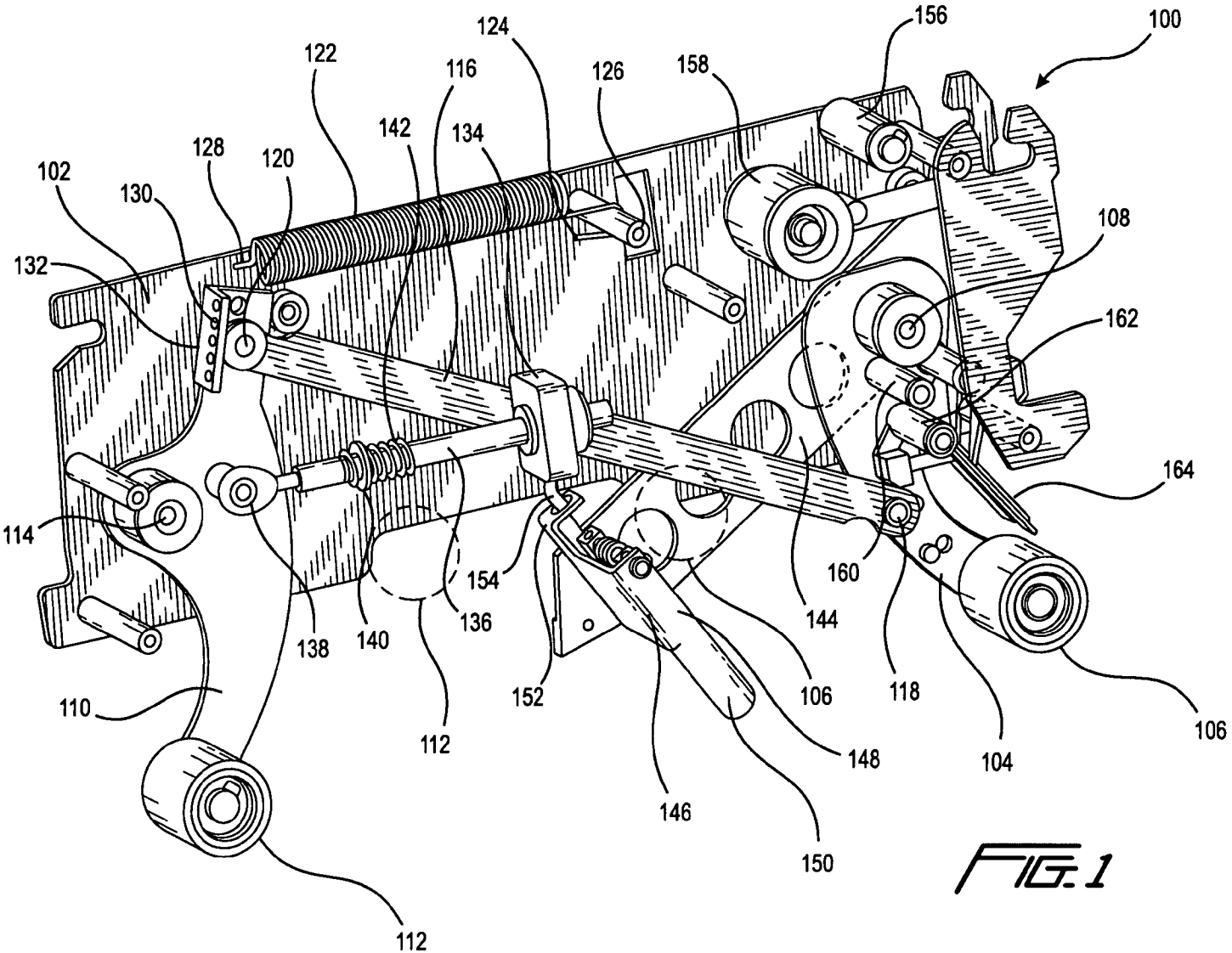
FIG. 1 is a perspective view of an overall carton or case sealing front and rear tape roller application system within which the new and improved mounting system for the front or rear tape application roller is adapted to be provided or incorporated in order to permit the existing front or rear tape application roller to be easily and quickly removed from its roller shaft, as well as for a new front tape application roller to be quickly and easily mounted upon the roller shaft so as to effectively replace the original worn front or rear tape application roller with a new or fresh front or rear tape application roller.

Referring now to the drawings, and more particularly to FIG. 1 thereof, an overall carton or case sealing front and rear tape roller application system, within which the new and improved mounting system for the front and rear tape application rollers, which has been constructed in accordance with the principles and teachings of the present invention and which shows the cooperative parts thereof, is adapted to be provided or incorporated in order to permit the existing front and rear tape application rollers to be easily and quickly removed from their respective roller shafts, as well as for a new front or rear tape application roller to be quickly and easily mounted upon the respective roller shaft so as to effectively replace the original worn front or rear tape application roller with the new or fresh front or rear tape application roller, is disclosed and is generally indicated by the reference character 100. More particularly, it is seen that the overall carton or case sealing front and rear tape roller application system 100 comprises a main mounting plate 102 by means of which a spring tension control system, more particularly disclosed within co-pending patent application entitled SPRING TENSION CONTROL SYSTEM FOR THE TAPE APPLICATION ROLLERS OF A TAPE ROLL DISPENSING CARTRIDGE ASSEMBLY, Ser. No. 12/073,143, filed on Feb. 29, 2008, is mounted upon the framework of the carton or case sealing machine. A first front application roller arm 104, upon the lower end portion of which is mounted a front carton or case sealing tape application roller 106 for applying the sealing tape to the vertically oriented front surface portion of the carton or case, is pivotally mounted upon the main mounting plate 102 by means of a first pivot pin assembly 108, and a second rear application roller arm 110, upon the lower end portion of which is mounted a rear carton or case sealing tape application roller 112 for applying the sealing tape to the vertically oriented rear surface portion of the carton or case, is pivotally mounted upon the main mounting plate 102 by means of a second pivot pin assembly 114.

A link bar 116 has a first end portion thereof pivotally connected to a central portion of the first front application roller arm 104 as at 118, while a second opposite end portion of the link bar 116 is pivotally connected to an upper end portion of the second rear application roller arm 110 as at 120 such that the link bar 116 operatively interconnects the first front and second rear application roller arms 104,110 together. Accordingly, it can be appreciated that when, for example, the front carton or case sealing tape application roller 106, mounted upon the first front application roller arm 104, encounters the vertically oriented front surface portion of the carton or case to be sealed with the sealing tape, the front carton or case sealing tape application roller 106 will initially be effectively pushed, by means of the vertically oriented front surface portion of the carton or case, toward the left, as viewed within FIG. 1, such that as a result of the pivotal movement of the first front application roller arm 104, in the clockwise direction, around its pivot axis as defined by means of its pivot pin assembly 108, the front carton or case sealing tape application roller 106 will effectively be moved along an arcuate path from its original or start position, as illustrated in solid lines within FIG. 1, to an end of movement position, as is illustrated in dotted lines within FIG. 1.

Simultaneously therewith, it can be readily appreciated that, as a result of the aforenoted operative interconnection defined between the first front application roller arm 104 and the second rear application roller arm 110 by means of the link bar 116, the second rear application roller arm 110 will be pivotally moved in a counterclockwise direction around its pivot axis, as defined by means of its pivot pin assembly 114. In this manner, the upper end portion of the second rear application roller arm 110 will be moved toward the left as viewed within FIG. 1 while the lower end portion of the second rear application roller arm 110, upon which is mounted the rear carton or case sealing tape application roller 112, such that the rear carton or case sealing tape application roller 112 will effectively be moved along an arcuate path from its original or start position, as illustrated in solid lines within FIG. 1, to an end of movement position, as is illustrated in dotted lines within FIG. 1.

It is also seen that a first spring-biasing means, in the form of a coil spring 122, has a first end portion 124 engaged with a mounting pin 126 which is fixedly mounted upon the main mounting plate 102, while a second opposite end portion 128 of the first spring-biasing means 122 is adapted to be engaged within any one of, for example, five apertures 130 defined within a bracket 132 which is integrally mounted upon the second rear application roller arm 110. In this manner, when the first front application roller arm 104 and the second rear application roller arm 110 are pivotally moved from their original positions, at which the front carton or case sealing tape application roller 106 and the rear carton or case sealing tape application roller 112 are respectively illustrated by means of solid lines within FIG. 1, to their end of movement positions at which the front carton or case sealing tape application roller 106 and the rear carton or case sealing tape application roller 112 are respectively illustrated by means of dotted lines within FIG. 1, the first spring biasing means 122 will be expanded whereby the same will cause the first front application roller arm 104 and the second rear application roller arm 110, upon which the front carton or case sealing tape application roller 106 and the rear carton or case sealing tape application roller 112 are respectively mounted, to be returned to their original or start positions, as illustrated by means of the solid lines within FIG. 1, when the first spring biasing means 122 is permitted to contract back to its original state, as illustrated within FIG. 1, at a predetermined point of time of the tape sealing operational cycle as will be explained more fully hereinafter. It is lastly noted in connection with the first spring biasing means 122, and the connection of its second end portion 128 to the bracket 132 mounted upon the second rear application roller arm 110, that the provision of, for example, the five different apertures 130 defined within the bracket 132 permits the actual tension of the first spring-biasing means 122 to be operatively adjusted as desired.

Continuing further, it is seen that a slide block 134 is movably mounted upon a guide rod 136, and that the left end portion of the guide rod 136 is pivotally connected to a substantially central portion of the second rear application roller arm 110 by means of a pivot pin assembly 138. The slide block 134 is pivotally connected to the link bar 116 by means of a pivot pin, not visible, which projects outwardly from, in effect, the back side of the slide block 134 so as to be disposed within an aperture, also not visible, which is defined within the link bar 116. In this manner, the slide block 134 is movable, along with the link bar 116, from its original or start position, as illustrated within FIG. 1, to an end of movement position when the link bar 116 is itself moved from its original or start position as illustrated within FIG. 1 to its end of movement position which correlates with the angular or pivotal movements of the first front application roller arm 104 and the second rear application roller arm 110 having the front carton or case sealing tape application roller 106 and the rear carton or case sealing tape application roller 112 respectively mounted thereon, as has been previously described. Still yet further, it is also seen that a stop member 140, in the form of, for example, a washer, is fixedly secured at a predetermined location upon the guide rod 136, and a second spring biasing means 142, in the form of a coil spring, is fixedly disposed upon the guide rod 136 as a result of effectively having several coils thereof being operatively engaged with the stop member or washer 140.

Accordingly, when the slide block 134 is moved toward the left, as viewed within FIG. 1, from its original or start position to its end of movement position adjacent to the stop member or washer 140, the second spring biasing means 142 will be compressed so as to exert an increased or enhanced amount of biasing force, pressure, or tension upon the second rear application roller arm 110 for an operational purpose that will be explained more fully hereinafter. It is lastly noted that a knife support arm 144, as more fully described within co-pending patent application entitled QUICK CHANGE KNIFE BLADE ASSEMBLY FOR A TAPE ROLL DISPENSING CARTRIDGE ASSEMBLY OF A CASE SEALING MACHINE, Ser. No. 12/073,138, filed Feb. 29, 2008, is also pivotally mounted upon the main mounting plate 102, wherein the knife support arm 144 is adapted to have a downwardly extending or dependent knife blade or cutting member 146 fixedly mounted thereon, the knife support arm 144 being biased in a downward mode by a spring-biasing means, not shown, such that the knife support arm 144 is normally disposed at its lowered position as illustrated within FIG. 1. A knife blade guard or cover 148 is pivotally mounted upon the knife support arm 144 so as to be movable between a first position at which the knife blade guard or cover 148 covers the knife blade or cutting member 146 so as to protect operator or maintenance personnel, and a second position at which the knife blade guard or cover 148 effectively uncovers the knife blade or cutting member 146 so as to permit the knife blade or cutting member 146 to cut the sealing tape in order to, for example, effectively define a rear tab portion of the sealing tape which is adapted to be applied, by means of a wiping operation, onto the vertically oriented rear surface portion of the carton or case by means of the rear carton or case sealing tape application roller 112.

The knife blade guard or cover 148 is provided with a dependent tab member 150 which is adapted to be engaged by the carton or case to be sealed, as the carton or case is being moved along its tape sealing path, so as to effectively move the knife guard or cover 148 from its first position, at which the knife blade guard or cover 148 covers the knife blade or cutting member 146, to its second position at which the knife blade guard or cover 148 effectively uncovers the knife blade or cutting member 146, and it is also noted that the knife blade guard or cover 148 is also provided with an upstanding bracket member 152 within which there is defined an aperture, not clearly visible within FIG. 1. Correspondingly, the slide block 134 is provided with a dependent lug member 154 which is adapted to be engaged within the aperture, not visible, which is defined within the upstanding bracket member 152 when the slide block 134 is disposed at its original or start position as illustrated within FIG. 1. In this manner, the knife blade guard or cover 148 is effectively prevented from being moved from its covered position with respect to the knife blade or cutting member 146 to its uncovered position with respect to the knife blade or cutting member 146 at an inappropriate time of the carton or case sealing operational cycle. Alternatively, when the slide block 134 is moved toward the left from its original or start position to its end of movement position, as viewed within FIG. 1, such as, for example, when the link bar 116 is moved from its original or start position, as illustrated within FIG. 1, to its end of movement position in correlation with the angular or pivotal movements of the first front application roller arm 104 and the second rear application roller arm 110, having the front carton or case sealing tape application roller 106 and the rear carton or case sealing tape application roller 112 respectively mounted thereon, as has been previously described, the lug member 154 will be disengaged from the aperture, not visible, defined within the upstanding backet member 152 of the knife blade guard or cover 148. In this manner, the knife blade guard or cover 148 will be permitted to be moved to its uncovered position with respect to the knife blade or cutting member 146 so as to, in turn, permit the knife blade or cutting member 146 to perform its sealing tape cutting function at the predetermined point in time of the carton or case sealing operation.

Having described the aforenoted structural components comprising the overall carton or case sealing front and rear tape roller application system 100, a brief operational cycle of the overall carton or case sealing front and rear tape roller application system 100 will now be described. More particularly, it is firstly noted that a leading end tab portion of the carton or case sealing tape is adapted to be routed, for example, from a tape supply roll, not shown, around a right external peripheral side surface portion of a first idler roller 156, beneath a lower external peripheral surface portion of the first idler roller 156, over an upper external peripheral surface portion of a second idler roller 158, and around a left external peripheral side surface portion of the second idler roller 158. From the second idler roller 158, the leading end tab portion of the carton or case sealing tape is conducted between third and fourth idler rollers 160,162 so as to effectively be conducted onto a guide plate 164 such that the free end portion of the leading end tab portion of the carton or case sealing tape will be disposed upon or alongside the right external peripheral side surface portion of the front carton or case sealing tape application roller 106. In this manner, the leading end tab portion of the carton or case sealing tape will effectively be interposed or sandwiched between the right external peripheral side surface portion of the front carton or case sealing tape application roller 106 and the vertically oriented front surface portion of the carton or case, when the vertically oriented front surface portion of the carton or case engages the front carton or case sealing tape application roller 106.

Subsequently, as the carton or case is then conveyed in the conveyance direction, which extends from right to left as viewed within FIG. 1, the front carton or case sealing tape application roller 106 will, in effect, be forced toward the left, as viewed within FIG. 1, and will also begin to move upwardly along the vertically oriented front surface portion of the carton or case, as the conveyed carton or case effectively pushes the front carton or case sealing tape application roller 106 out of its way whereby the front carton or case sealing tape application roller 106 will effectively apply the leading end tab portion of the carton or case sealing tape onto the vertically oriented front surface portion of the carton or case by means of a wiping action. As a result of the aforenoted movement of the front carton or case sealing tape application roller 106, the first front application roller arm 104 will be forced to rotate in the clockwise direction around its pivot pin assembly 108 thereby causing the link bar 116 to effectively be moved toward the left and to be simultaneously rotated a predetermined amount, in the counterclockwise direction, around a pivot axis effectively defined by means of its connection to the slide block 134 and as respectively permitted by means of the pivotal connections 118,120 defined between the opposite ends of the link bar 116 and the first and second front and rear application roller arms 104,110.

In addition, since the second rear application roller arm 110 is operatively connected to the first front application roller arm 104 by means of the link bar 116, the second rear application roller arm 110 will be pivoted or rotated in the counterclockwise direction around its pivot pin assembly 114 whereby the second carton or case sealing tape application roller 112 will begin to move upwardly and toward the first carton or case sealing tape application roller 106 until both of the front and rear carton or case sealing tape application rollers 106,112 ultimately reach their end of movement positions, as illustrated by means of the dotted lines within FIG. 1, at which point in time the front carton or case sealing tape application roller 106 will be disposed upon the horizontally oriented upper surface portion of the carton or case while the second carton or case sealing tape application roller 112 will be disposed at a position which is spaced just above the upper surface portion of the carton or case. As a result of such movements, the front carton or case sealing tape application roller 106 will also be able to wipe the carton or case sealing tape along the upper surface portion of the carton or case in the direction extending from the vertically oriented front surface portion of the carton or case toward the vertically oriented rear surface portion of the carton or case as the carton or case is being continuously conveyed along its conveyance path which is now, in effect, disposed beneath the front and rear carton or case sealing tape application rollers 106,112.

It is also to be noted at this point in time that in view of the substantially leftward movement of the link bar 116, and its operative connection to the slide block 134, the slide block 134 will be moved along the guide rod 136 such that the dependent lug member 154 of the slide block 134 will be disengaged from the aperture formed within the bracket member 152 of the knife blade guard or cover 148. In this manner, as the carton or case is being conveyed along its conveyance path, the upper portion of the vertically oriented front surface portion of the carton or case will encounter the tab member 150 of the knife blade guard or cover 148 so as to effectively pivot the same to its uncovered position thereby uncovering or exposing the knife blade or cutting member 146. In addition, the vertically oriented front surface portion of the carton or case will also encounter the knife support arm 144 so as to effectively move the same, along with the knife blade or cutting member 146 and the knife blade guard or cover 148 mounted thereon, to an elevated position, against its spring-biasing means, for a purpose to be explained hereinafter and which is also described within the aforenoted copending patent application entitled QUICK CHANGE KNIFE BLADE ASSEMBLY FOR A TAPE ROLL DISPENSING CARTRIDGE ASSEMBLY OF A CASE SEALING MACHINE.

Subsequently, as the front carton or case sealing tape application roller 106 approaches the upper rear edge portion of the carton or case, and in view of the fact that the front carton or case sealing tape application roller 106 is disposed at its dotted line position as illustrated within FIG. 1, whereby the front carton or case sealing tape application roller 106 is seen to be disposed immediately adjacent to the uncovered or exposed knife blade or cutting member 146, the front carton or case sealing tape application roller 106 will, in effect, fall off or be disengaged from the upper surface portion of the carton or case, and immediately thereafter, the knife support arm 144 will likewise, in effect, fall off or be disengaged from the upper surface portion of the carton or case. In view of the aforenoted spring-biasing of the knife support arm 144, the knife support arm 144 will now be biased back toward its original lowered position as illustrated within FIG. 1, whereby the knife blade or cutting member 146 can cut or sever the carton or case sealing tape thereby forming a rear tab portion of the carton or case sealing tape which is to be applied along the vertically oriented rear surface portion of the carton or case by means of a wiping action performed by means of the rear carton or case sealing tape application roller 112.

It is to be noted that since both the front carton or case sealing tape application roller 106 and the knife support arm 144 are no longer engaged with or disposed upon the upper surface portion of the carton or case being sealed, the rear carton or case sealing tape application roller 112 is able to, in effect, be lowered into engagement with the upper surface portion of the carton or case being sealed. In this manner, the rear carton or case sealing tape application roller 112 can perform its sealing function with respect to rear tab portion of the carton or case sealing tape along the vertically oriented rear surface portion of the carton or case. It is also to be noted that since the rear carton or case sealing tape application roller 112 is at this point in time disposed at its dotted line position, as illustrated within FIG. 1, whereby the rear carton or case sealing tape application roller 112 will also be disposed immediately adjacent to the left end portion of the knife support arm 144 and the knife blade or cutting member 146, then when the knife support arm 144 and the knife blade or cutting member 146 move to their lowered positions at which the knife blade or cutting member 146 cuts or severs the sealing tape in order to form the aforenoted rear tab portion of the sealing tape, the rear carton or case sealing tape application roller 112 will be substantially disposed at the upper rear edge or corner region of the carton or case. Still further, in view of the aforenoted disengagement of the front carton or case sealing tape application roller 106 from the upper surface portion of the carton or case, and the commencement of the downward movement thereof through, in effect, its return stroke or movement between its dotted line position and its solid line position, the second spring biasing means 142, which is disposed upon the guide rod 136 and which was previously compressed by means of the slide block 134 when the slide block 134 was moved from its rightwardmost position, illustrated within FIG. 1, to its leftwardmost position adjacent to the stop member 140, will now tend to expand back toward its normally non-compressed state.

It is interesting to note, however, that the expansion of the second spring-biasing means 142 back toward its normally non-compressed state does not directly cause the second rear application roller arm 110 to move with an increased or enhanced amount of speed in the clockwise direction so as to, in turn, cause the rear carton or case sealing tape application roller 112 to rapidly move toward the left and back to its original position, as illustrated in solid lines as viewed within FIG. 1, so as to rapidly engage and apply the rear tab portion of the sealing tape onto the vertically oriented rear surface portion of the carton or case by means of the aforenoted wiping action. In fact, such rapid clockwise movement of the second rear application roller arm 110, and the consequent rapid leftward movement of the rear carton or case sealing tape application roller 112, is accomplished, in effect, indirectly as a result of the expansion of the second spring-biasing means 142. More particularly, when the rear carton or case sealing tape application roller 112 is disposed at its dotted line position as illustrated within FIG. 1, the pivot pin assembly 138, operatively connecting the left end portion of the guide rod 136 to the second rear application roller arm 110, will, in effect, be disposed above the pivot pin assembly 114, by means of which the second rear application roller arm 110 is pivotally mounted upon the main mounting plate 102, as a result of the angular movement of the second rear application roller arm 110 around its pivot pin assembly 114 as the rear carton or case sealing tape application roller 112 is moved from its original solid line position as illustrated within FIG. 1 to its dotted line position as illustrated within FIG. 1. Accordingly, when the second spring biasing means 142 undergoes its expansion, if the expansion force of the same was directed toward the left so as to be imparted directly toward the second rear application roller arm 110, as viewed in FIG. 1, it would be oriented along a direction which would not in fact tend to move the second rear application roller arm 110 in the clockwise direction so as to in fact return the second rear application roller arm 110, and the rear carton or case sealing tape application roller 112 to its original solid line position.

In fact, therefore, the expansion force of the second spring biasing means 142 operates or acts, in effect, in conjunction with the contraction forces of the first spring biasing means 122, which was previously expanded when the front and rear carton or case sealing tape application rollers 106,112 were moved from their solid line positions to their dotted line positions as illustrated within FIG. 1, so as to be quickly imparted to and impressed upon the slide block 134 in order to quickly move the same along the guide rod 136 back toward its original position, as illustrated within FIG. 1. In this manner, the link bar 116 will be rapidly returned to its original position, as illustrated within FIG. 1, under the influence of both the contraction force of the first spring-biasing means 122 and the expansion force of the second spring-biasing means 142, such that the left end portion of the link bar 116, which is pivotally connected to the upper end portion of the second rear application roller arm 110, will, in effect, act upon the upper end portion of the second rear application roller arm 110 so as to cause the same to be rapidly rotated in the clockwise direction so as to in fact rapidly move the rear carton or case sealing tape application roller 112 in the leftward direction, back toward its original position as illustrated within FIG. 1, for its rapid engagement with the rear tab portion of the sealing tape in order to quickly and properly apply the same onto the vertically oriented rear surface portion of the carton or case being sealed.

Figure 2:
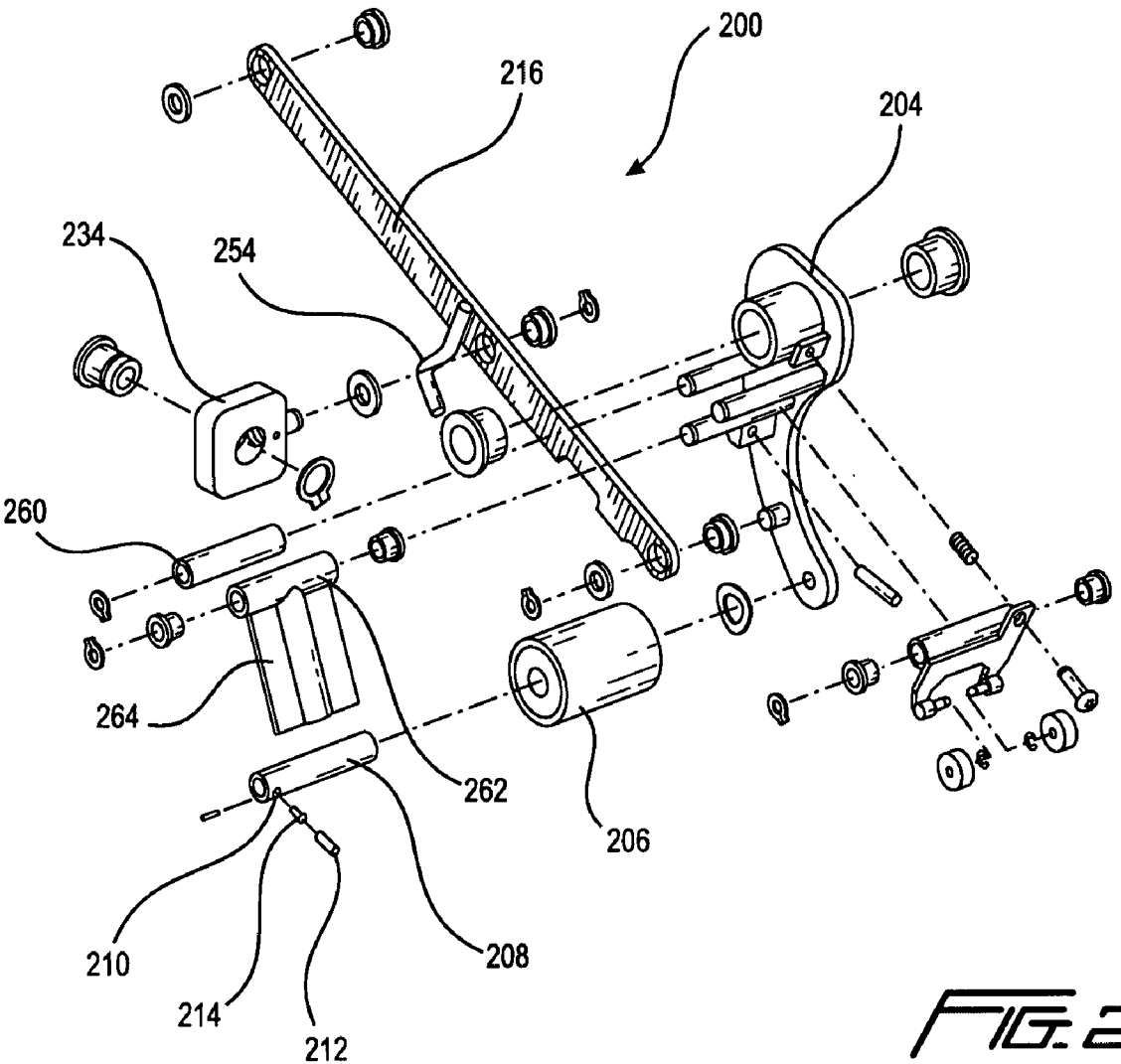
FIG. 2 is an exploded view of the new and improved system, as constructed in accordance with the principles and teachings of the present invention and showing the cooperative parts thereof, for mounting, for example, the front tape application roller, as incorporated within the overall carton or case sealing front and rear tape application system as disclosed within FIG. 1, in order to permit, for example, the front tape application roller to be quickly and easily removed from its roller shaft, as well as for a new front tape application roller to be quickly and easily mounted upon the roller shaft so as to effectively replace the original worn front application roller, it being understood that a similar system for mounting the rear tape application roller can likewise be adapted and incorporated within the overall carton or case sealing apparatus disclosed within FIG. 1 for mounting, for example, the rear tape application roller.

Having described the aforenoted structural components comprising the overall carton or case sealing front and rear tape roller application system 100, and the operation thereof, the new and improved front or rear tape application roller mounting system, for use in connection or incorporation within the overall carton or case sealing front and rear tape roller application system 100, as illustrated within FIG. 1, is now disclosed within FIG. 2 and is generally indicated by the reference character 200. It is noted that component parts illustrated within FIG. 2, which correspond to component parts illustrated in FIG. 1, will be designated by corresponding reference characters except that they will be within the 200 series. Also, references to the front tape application roller mounting system for removably mounting the front tape application roller 206 are equally applicable to the rear tape application roller system for removably mounting the rear tape application roller 112 as illustrated within FIG. 1. More particularly, it is seen that the new and improved front tape application roller mounting system 200 comprises the front tape application roller 206 which is adapted to be rotatably mounted upon a roller shaft 208 which, in turn, is adapted to be fixedly mounted upon the lower end portion of the front tape application roller arm 204. The axially outer end portion of the roller shaft 208 is provided with a radially oriented bore 210 within which a biasing spring 212 is adapted to be mounted. The biasing spring 212 is adapted to be also be disposed around the shaft or shank portion of a double-headed detent pin 214 so as to normally spring bias the detent pin 214 in a radially outward direction, it being appreciated that the second internal head, not shown, is provided upon the inner end portion of the detent pin 214 from preventing its entire removal from the bore 210.

Accordingly, when the spring-biased detent pin 214 is disposed at its radially outward position, the spring-biased detent pin 214 will normally engage, for example, the left end portion of the front tape application roller 206, as viewed in FIG. 2, so as to effectively block the removal of the front tape application roller 206 from its roller shaft 208 and thereby ensure the fact that the front tape application roller 206 is maintained upon its roller shaft 208 when so desired and is not inadvertently or accidentally removed from its roller shaft 208 by operator personnel. Conversely, when the front tape application roller 206 is in fact to be removed from its roller shaft 208, such as, for example, when the front tape application roller 206 is to be replaced as result of, for example, being worn, the spring-biased detent pin 214 is moved or depressed radially inwardly, against the spring bias of the biasing spring 212 so as to effectively be moved into the bore 210 formed within the roller shaft 208.

In this manner, the spring-biased detent pin 214 will no longer be disposed at its radially outward position engaging and blocking the left end portion of the front application roller 206. Accordingly, the front tape application roller 206 may then, in effect, be slidably moved along the outer peripheral surface portion of the roller shaft 208 so as to pass over or beyond the radially inwardly disposed or depressed spring-biased detent pin 214 and thereby be removed from the roller shaft 208. A new front tape application roller 206 can then be slidably mounted upon the roller shaft 208, provided that the spring-biased detent pin 214 is maintained at its radially inwardly depressed position, and after the new front tape application roller 206 has passed over or beyond the radially inwardly depressed spring-biased detent pin 214, the spring-biased detent pin 214 can be released so as to permit the biasing spring 212 to return the spring-biased detent pin 214 to its normally radially outwardly disposed position thereby effectively again blocking any leftward movement, and removal of, the front tape application roller 206 from its roller shaft 208 so as to in fact maintain the new front tape application roller 206 mounted upon the roller shaft 208.

Thus, it may be seen that in accordance with the teachings and principles of the present invention, there has been provided a new and improved front or rear tape application roller mounting system wherein means has been provided for permitting the front and rear tape application rollers of the carton or case sealing apparatus to be quickly and easily removed and replaced by new or fresh front and rear tape application rollers by operator or maintenance personnel without the need for the use of special tools.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. An easily and quickly removable tape application roller assembly for use within a carton or case sealing machine, comprising:

a roller shaft defined around an axis;

an application roller rotatably disposed upon said roller shaft and also slidably disposed upon said roller shaft so as to be capable of being disposed upon said roller shaft and of being slidably removed from said roller shaft;

a bore defined within said roller shaft; and a detent pin assembly comprising a detent pin which is disposed within said bore of said roller shaft for movement between a first position at which said detent pin projects outwardly from said bore of said roller shaft so as to engage said application roller and thereby effectively block and prevent said application roller from being removed from said roller shaft, and a second position at which said detent pin is moved inwardly into said bore of said roller shaft so as to be disengaged from said application roller and thereby permit said application roller to be slidably removed from said roller shaft.

2. The assembly as set forth in claim 1, wherein:

said application roller comprises a front sealing tape application roller for applying sealing tape to a front end portion of the carton or case.

3. The assembly as set forth in claim 1, wherein:

said application roller comprises a rear sealing tape application roller.

4. The assembly as set forth in claim 1, wherein:

said detent pin assembly, mounted upon said roller shaft for movement between said first position at which said detent pin is engaged with said application roller so as to effectively block and prevent said application roller from being removed from said roller shaft, and said second position at which said detent pin is disengaged from said application roller so as to permit said application roller to be removed from said roller shaft, comprises a spring-biased detent pin assembly.

5. The assembly as set forth in claim 4, wherein said spring biased detent pin assembly comprises:

said detent pin, having a shaft portion, is disposed within said bore defined within said bore; and a spring which is disposed within said bore in a radially outward expanded state, and which is also disposed around said shaft portion of said detent pin, so as to normally bias said detent pin in a radially outward direction such that said detent pin is normally disposed at said first position at which said detent pin is engaged with said application roller so as to effectively block and prevent said application roller from being removed from said roller shaft, and wherein said spring can be compressed in a radially inward direction so as to be disposed in a radially inward compressed state such that said detent pin is disposed at said second position at which said detent pin is disengaged from said application roller so as to permit said application roller to be removed from said roller shaft.

6. A carton or case sealing machine, comprising:

a roller shaft defined around an axis;

an application roller rotatably disposed upon said roller shaft and also slidably disposed upon said roller shaft so as to be capable of being disposed upon said roller shaft and of being slidably removed from said roller shaft;

a bore defined within said roller shaft; and a detent pin assembly comprising a detent pin which is disposed within said bore of said roller shaft for movement between a first position at which said detent pin projects outwardly from said bore of said roller shaft so as to engage said application roller and thereby effectively block and prevent said application roller from being removed from said roller shaft, and a second position at which said detent pin is moved into said bore of said roller shaft so as to be disengaged from said application roller and thereby permit said application roller to be slidably removed from said roller shaft.

7. The carton or case sealing machine as set forth in claim 6, wherein:

said application roller comprises a front sealing tape application roller for applying sealing tape to a front end portion of the carton or case.

8. The carton or case sealing machine as set forth in claim 6, wherein:

said application roller comprises a rear sealing tape application roller for applying sealing tape to a rear end portion of the carton or case.

9. The carton or case sealing machine as set forth in claim 6, wherein:

said detent pin assembly, mounted upon said roller shaft for movement between said first position at which said detent pin is engaged with said application roller so as to effectively block and prevent said application roller from being removed from said roller shaft, and said second position at which said detent pin is disengaged from said application roller so as to permit said application roller to be removed from said roller shaft, comprises a spring-biased detent pin assembly.

10. The carton or case sealing machine as set forth in claim 9, wherein said spring biased detent pin assembly comprises:

said detent pin, having a shaft portion, is disposed within said bore defined within said bore; and a spring which is disposed within said bore in a radially outward expanded state, and which is also disposed around said shaft portion of said detent pin, so as to normally bias said detent pin in a radially outward direction such that said detent pin is normally disposed at said first position at which said detent pin is engaged with said application roller so as to effectively block and prevent said application roller from being removed from said roller shaft, and wherein said spring can be compressed in a radially inward direction so as to be disposed in a radially inward compressed state such that said detent pin is disposed at said second position at which said detent pin is disengaged from said application roller so as to permit said application roller to be removed from said roller shaft.

11. The assembly as set forth in claim 5, wherein:

said bore is defined within an outer peripheral surface portion of said roller shaft; and said detent pin projects radially outwardly from said bore defined within said outer peripheral surface portion of said roller shaft so as to engage said application roller and thereby block and prevent said application roller from being removed from said roller shaft.

12. The carton or case sealing machine as set forth in claim 9, wherein:

said bore is defined within an outer peripheral surface portion of said roller shaft; and said detent pin projects radially outwardly from said bore defined within said outer peripheral surface portion of said roller shaft so as to engage said application roller and thereby block and prevent said application roller from being removed from said roller shaft.

* * * * *